United States Patent [19]

Young et al.

[11] Patent Number: 4,481,421

[45] Date of Patent: Nov. 6, 1984

[54] LITHIUM-6 COATED WIRE MESH NEUTRON DETECTOR

[75] Inventors: Charles A. Young, San Diego; Bruce D. Geelhood, La Mesa, both of Calif.

[73] Assignee: The United States of America as represented by the Secretary of the Navy, Washington, D.C.

[21] Appl. No.: 381,099

[22] Filed: May 24, 1982

[51] Int. Cl.[3] ..... H01J 47/12

[52] U.S. Cl. ..... 250/390; 250/385; 250/374

[58] Field of Search ..... 250/390, 391, 392, 385, 250/374; 376/255, 153, 155

[56] References Cited

U.S. PATENT DOCUMENTS

| | | | |
|---|---|---|---|
| 2,186,757 | 1/1940 | Kallmann et al. | 250/482.1 |
| 2,188,115 | 1/1940 | Kallmann et al. | 250/458.1 |
| 2,297,478 | 9/1942 | Kallmann et al. | 250/475.2 |
| 2,604,598 | 7/1952 | Mead et al. | 250/390 |
| 2,760,078 | 8/1956 | Youmans | 376/153 |
| 3,129,329 | 4/1964 | Love et al. . | |
| 3,222,521 | 12/1965 | Einfeld | 250/391 |
| 3,290,500 | 12/1966 | Bokhari et al. . | |
| 3,320,421 | 5/1967 | Krogstad . | |
| 3,335,277 | 8/1967 | Schmid et al. | 250/390 |
| 3,911,283 | 10/1975 | Williams | 250/483.1 |
| 3,955,087 | 5/1976 | Ashe | 250/360.1 |
| 3,999,071 | 12/1976 | Siffert et al. | 250/370 |
| 4,266,132 | 5/1981 | Marshall | 250/359.1 |
| 4,365,159 | 12/1982 | Young | 250/385 |

OTHER PUBLICATIONS

Deme, "Monitoring the Beam of Pulsed Neutron Sources", Instru. & Exp. Techniques, 17, (3 pt. 1), pp. 671–672, May/Jun. 1974.

*Primary Examiner*—Alfred E. Smith
*Assistant Examiner*—Carolyn E. Fields
*Attorney, Agent, or Firm*—Robert F. Beers; Ervin F. Johnston; Harvey Fendelman

[57] ABSTRACT

A neutron detection apparatus is provided which includes a selected number of surfaces of lithium-6 coated wire mesh and which further includes a gas mixture in contact with each sheet of lithium-6 coated wire mesh for selectively reacting to charged particles emitted or radiated by the lithium-6 coated mesh. A container is provided to seal the lithium-6 coated mesh and the gas mixture in a volume from which water vapor and atmospheric gases are excluded, the container having one or more walls which are transmissive to neutrons. Monitoring equipment in contact with the gas mixture detects the generation of charged particles in the gas mixture and, in response to such charged particles, provides an indication of the flux of neutrons passing through the volume of the detector.

24 Claims, 5 Drawing Figures

LITHIUM-6 COATED WIRE MESH NEUTRON DETECTOR

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The invention disclosed and claimed herein pertains generally to the field of neutron detection devices and, more particularly, to neutron detection devices of the type which employ lithium-6, in a solid form, to respond to neutrons by radiating charged particles into an ionizable counting gas.

At present, most high-sensitivity neutron detectors of the radiator, ionizable gas type employ either $^{10}BF_3$ or $^3He$, in a gaseous state, as the radiating medium for the detector, i.e., for the detector component which interacts with neutrons and subsequently radiates ionizing particles in response thereto. $^3He$ is always in a gaseous state at practical temperatures and pressures. $^{10}BF_3$ must be employed in a gaseous state, since the principal ionizing particle which results from the reaction between a neutron and a boron nucleus of $^{10}BF_3$ in an alpha particle which is of extremely short range, e.g., $5\times10^{-3}$ mm. If a reaction generating an alpha particle were to take place within a solid material, the dimensions of the material would have to be extremely small, to prevent the alpha particles from being trapped therewithin.

Because of the low density of $^{10}BF_3$ and $^3He$ at ordinary pressures, they must be contained in chambers of large volume in order to be used as the radiator component in a neutron detector. Consequently, such detectors tend to be comparatively large or bulky. While neutron detectors are available which have used a solid layer of $^{10}B$ as an alpha particle radiator, the layer must be kept very thin, as aforementioned, e.g., $10^{-2}$ mm, and it may still be necessary to supplement the $^{10}B$ radiator with one of the above gaseous radiator components. In the past, solid lithium-6 ($^6Li$) has been used as the neutron sensitive component in a radiator, ionizable gas neutron detector wherein the lithium-6 is coated upon the curved inner surface of a cylinder. See, for example, U.S. Pat. No. 2,721,944, issued Sept. 9, 1950, which discloses a neutron detector for use in geological exploration of oil fields. Also, in a prior patent application of Charles A. Young, (U.S. patent application Ser. No. 06/203,006, filed Nov. 3, 1980, now U.S. Pat. No. 4,365,159), incorporated herein by reference, a neutron detector was disclosed in which a number of flat sheets of lithium-6 are employed in a neutron detector such that the sheets are stacked in parallel layers within a thin, flat container. In that scheme, a separate layer of counting wires was required for each lithium-6 foil layer.

SUMMARY OF THE INVENTION

In accordance with the present invention, a neutron detection apparatus is provided which includes a lithium-6 based neutron detector which contains a large amount of useful lithium-6 within a relatively small detector volume. This is accomplished by utilizing a lithium-6 coated wire mesh detector containing the active lithium-6 as a coating over a very thin wire mesh.

These lithium-6 coated meshes are then stacked to provide several layers of lithium for every layer of counting wires utilized. A counting gas mixture is in contact with each of the layers of lithium-6 coated wire mesh for reacting to particles radiated from the lithium coating. A container mechanism is provided for sealing the layers of lithium-6 coated wire mesh and the reacting gas mixtue within a volume from which water vapor and atmospheric gases are excluded, the container having walls which are transmissive to neutrons. A monitoring device in contact with the gas detects reactions in the gas and, in response to detected reactions, provides an output which represents the flux of neutrons passing through the detector volume. A high voltage supply and a resistive voltage divider string are connected to the respective sheets or layers of lithium-6 coated wire mesh to drift the electrons produced by the passage of the charge particles through the counting gas out to the layer of high-voltage counting wires. The signal indicating a neutron capture is produced when a triton or alpha particle escapes the lithium-6 coated mesh and ionizes the counting gas. The electrons produced by the ionization are drifted through the holes in the mesh layers into the region of the high voltage counting wires. As the electrons are accelerated toward the counting wires, they ionize other counting gas atoms producing more free electrons, i.e. resulting in gas gain. The current pulse produced in the counting wire when all these electrons are collected serves as the electronic signal. This signal can then be used by a standard amplifier/discriminator to produce a logic pulse which can be counted.

The lithium-6 mesh detector of the present invention has the advantage that the lithium-6 coated wire mesh is a self supporting structure and thereby obviates the necessity of providing a separate support structure as was required in the previously referred to U.S. Pat. No. 4,365,159. Further, the present invention has the advantage of a higher lithium-6 content per detector volume which is made possible by the action of the electrons drifting through several layers of the wire mesh. Additionally, the lithium-6 mesh detector scheme of the present invention may be manufactured with a lower detector weight than previous designs. The thin lithium-6 foils used in prior art designs did not have the mechanical strength to support themselves and required supporting wires. The lithium-6 coated mesh of the present invention is self supporting due to the stainless steel core utilized. The cylindrical geometry of the coated wire maximizes the solid angle for charge particle escape. The ability to stack up several layers of lithium-6 coated meshes between counting-wire layers reduces the detector thickness and weight from a comparable lithium-6 foil detector as disclosed in U.S. Pat. No. 4,365,159. The major weight of this type of lithium-6 detector is in the counting-wire frame and high-voltage insulators. A layer of high voltage counting wires must be separated from the lithium-6 layer by at least 0.3 cm to avoid high-voltage breakdowns. The layers of lithium-6 coated mesh can be separated by as little as 0.1 cm. Thus, a 6-layer foil detector as disclosed in the above referred to U.S. Pat. No. 4,365,159 would be about 4.5 cm thick and have seven layers of high voltage counting wires. However, a six-layer mesh detector in accordance with the present invention would be about 1.5 cm thick and have only one layer of high-voltage counting wires.

OBJECTS OF THE INVENTION

Accordingly, it is the primary object of the present invention to provide a lighter, more compact neutron detector of high sensitivity.

It is a concomitant object of the present invention to disclose a thin lithium-6 based neutron detector which contains a large amount of useful lithium-6 within a relatively small detector volume.

It is a further object of the present invention to disclose a lithium neutron detector in which the lithium detector portion is self supporting.

It is another object of the present invention to disclose a lithium neutron detector which requires only one layer of counting wires for many layers of detectors.

It is a further object of the present invention to disclose a neutron detector that is easier to manufacture than prior art designs.

Other objects and many of the attendant advantages of this invention will be readily appreciated as the same becomes better understood by reference to the following detailed description when considered in connection with the accompanying drawings.

DETAILED DESCRIPTION OF THE PREFERRED EMBODIMENT

Figure 1:
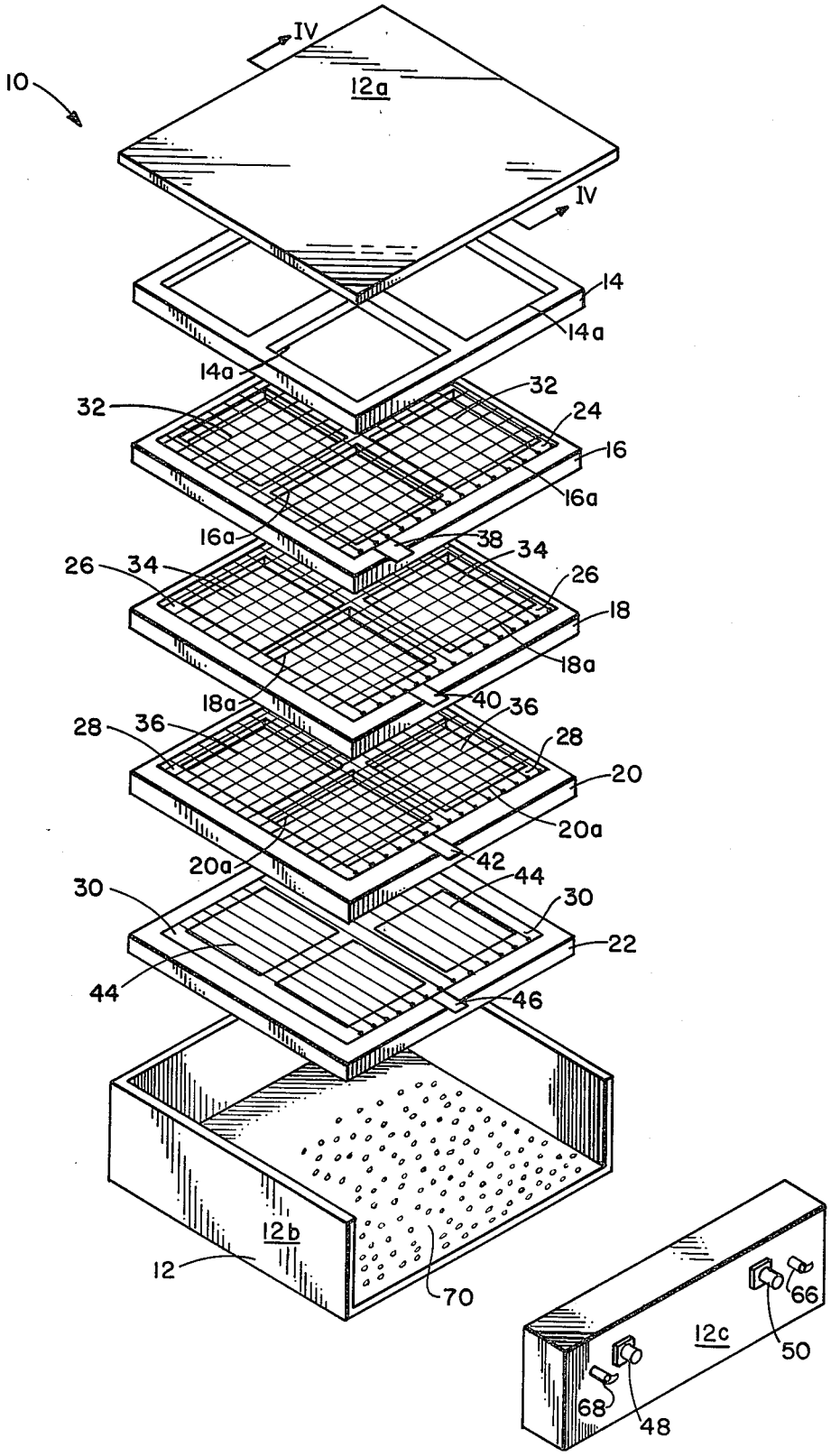
FIG. 1 is an exploded perspective view of Applicants' invention with the electronic components thereof omitted for clarity of illustration.

Referring now to FIG. 1, there are shown various components which may be assembled to form a three layer lithium-6 neutron detector 10. It is to be understood at this point that, although the lithium-6 neutron detector 10 of the present invention is described and illustrated herein as containing three layers of lithium-6 mesh components, a greater or fewer number of such layers may be utilized depending upon the particular application intended. Detector 10 includes a housing or container 12 having a top member 12*a*, a base member 12*b* including a back wall and a front wall member 12*c*. Preferably, the container 12 is formed of brass, stainless steel, or other material which is highly transmissive to neutrons and, more specifically, thermal neutrons. Detector 10 further includes an insulating spacer frame 14 and three insulating spacer frames 16, 18 and 20 which are positioned in a stacked arrangement as illustrated. Below the insulating spacer frame 20 is insulating spacer frame 22 utilized to support the count wires to be described. The insulating support frames 14, 16, 18, 20 and 22 may be formed of polypropylene, polyethylene, nylon, polycarbonate or any other suitable insulating type material that preferably is lightweight. The support frames 14, 16, 18 and 20 each have internal support members 14*a*, 16*a*, 18*a* and 20*a*, respectively, as is illustrated. The inner support members are arranged as illustrated to form four windows in the support frame structures 14, 16, 18 and 20 as can be seen in the drawings. On the top surface of the inner periphery of support frame 16, 18, 20 and 22 there is affixed on the support frames by suitable means, e.g. electroless metal plating and electroplating processes as are well known, conductive strips 24, 26, 28 and 30. No such conductive strip is required on insulating spacer 14 which is utilized solely as a spacer. A first layer of lithium-6 coated wire mesh 32 is placed over the windows formed in insulating spacer 16 and in mechanical and electrical contact with the conductive strip 24. Similarly, a second layer of lithium-6 coated wire mesh 34 is placed over the four windows in the insulating spacer 18 in mechanical and electrical contact with the conductive strip 26. Likewise, a third layer of lithium-6 coated wire mesh 36 is placed over the four windows in insulating spacer 20 and in mechanical and electrical contact with the conductive strip 28. Conductive tabs 38, 40 and 42 extend, respectively, from the conductive strips 24, 26 and 28. Insulating spacer 22 has stretched across its top surface a number of count wires 44 extending from the rear portion of insulating spacer 22 to the front portion of insulating spacer 22 and mechanically affixed to conductive strip 30 is electrically conductive tab member 46. Front face 12*c* of container 12 has affixed thereto by suitable mechanical means a first electrical connector 48 and a second high voltage electrical connector 50. Both electrical connectors 48 and 50 may be of the solderable, hermetically-sealed, BNC type.

Figure 3:
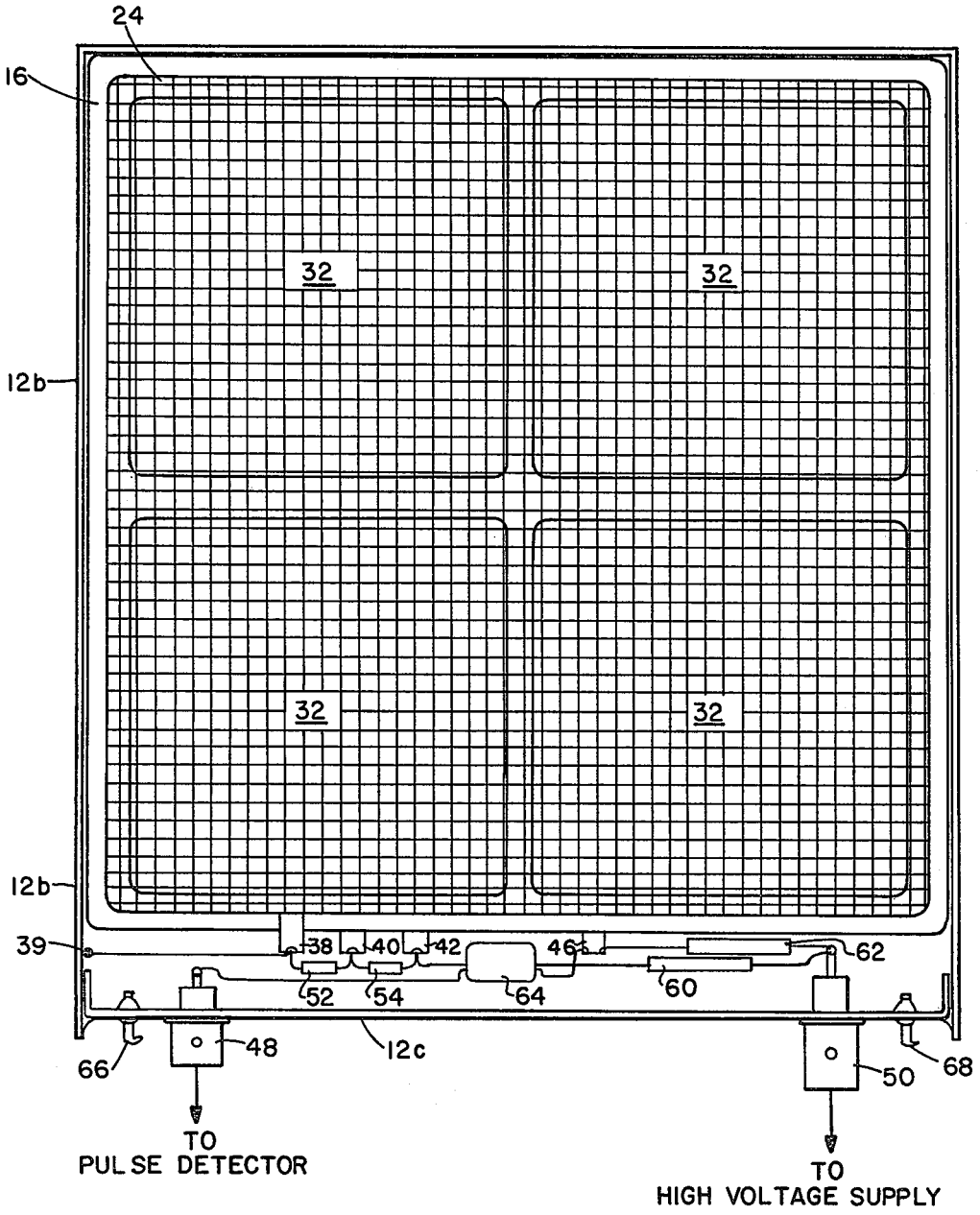
FIG. 3 is a top view of Applicants' invention with the cover 12*a* and frame 14 removed and illustrating the internal electronic components thereof.

Referring to FIG. 3 there is illustrated a top view of the detector 10 of the present invention with the top member 12*a* of container 12 and the insulating spacer 14 removed. It is seen in FIG. 3 that conductive tab 38 is grounded to the metal container 12 at point 39 and also that a resistive voltage divider string comprised of resistors 52, 54 and 60 as well as resistor 62 and capacitor 64 are connected, respectively, between the conductive tabs 38, 40, 42, and 46 and the electrical connectors 48 and 50 as illustrated. As an example, resistor 52 may have a value of 0.1 megaohms, resistor 54 may have a value of 0.1 megaohms, resistor 62 may have a value of 0.1 megaohm and resistor 60 may have a value of 1.8 megaohms. Alternative means of obtaining the drift voltages could be employed. As is seen in both FIGS. 1 and 3, the front cover member 12*c* of container 12 also has mechanically affixed thereto and extending therethrough pinch off tubes 66 and 68. The pinch off tubes 66 and 68 may be ⅛" copper tubing soldered into the end plate 12*c*. Contained within container 12 after device 10 is fully assembled is a suitable counting gas 70 such as, for example, 90% Argon, 10% methane mixture which is introduced via pinch off tube 66 and which is evacuated, if desired, via tube 68. Connector 50 is connected to a high voltage, voltage supply such as a 2,000 volt supply and as is seen in FIG. 3, connector 48 is connected to a pulse detector 72 comprised of amplifier/discriminator 74 and counter/timer 76. It can also be seen in FIG. 4 that front cover 12*c* may be fitted in place between the top cover 12*a* and the bottom of container 12 and solder sealed by applying solder 78 and hermetically sealing the container 12 to contain the counting gas 70, the insulating frames 14, 16, 18, 20 and 22 and the wire mesh components 32, 34 and 36, along with the counting wires 44 and the internal electronic components.

Figure 2:
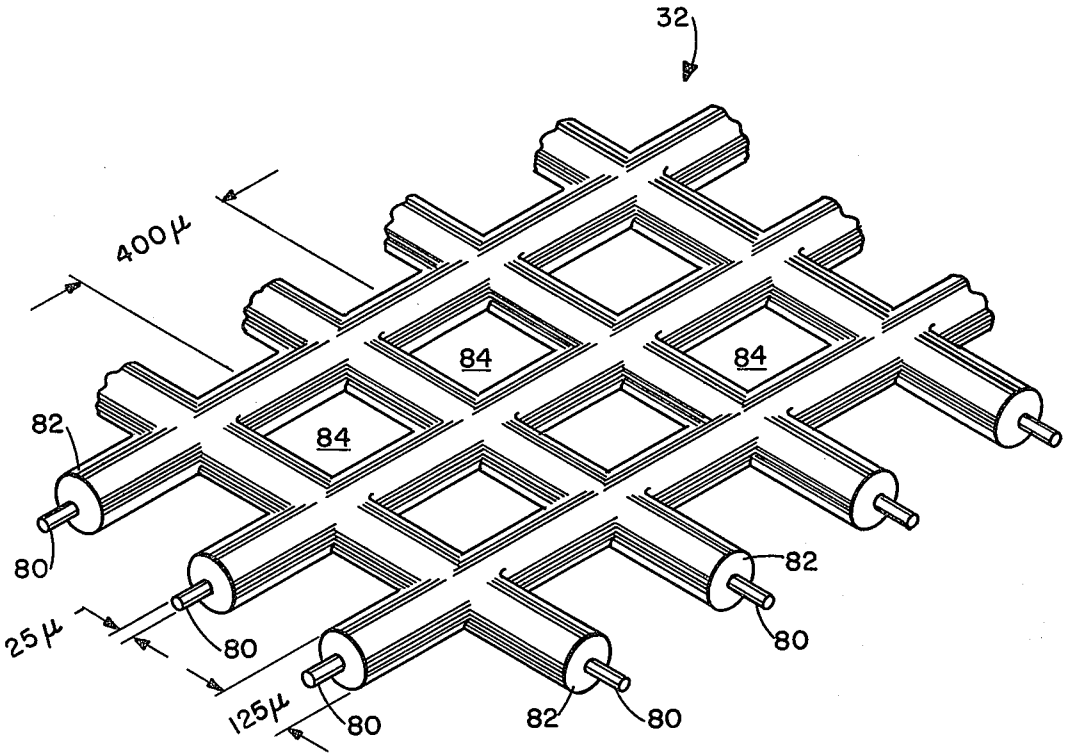
FIG. 2 is a magnified isometric view of a portion of the lithium-6 wire mesh component of Applicants' invention.

Referring to FIG. 2 wherein there is illustrated a magnified view of a portion of the layer of lithium-6 wire mesh 32, it being understood that the layers 34 and 36 of lithium-6 wire mesh are identical to layer 32, it can be seen that the lithium-6 wire mesh 32 includes a wire mesh foundation including wires 80 arranged to form a mesh or screen type structure. The wire foundation 80 may be comprised of stainless steel, nickel, beryllium, tungsten, or any other metal which is sufficiently strong and will not react chemically or alloy with the lithium-6 coating 82. The diameter of the supporting core wires 80 is preferably 25 microns and the center-to-center distance between adjacent apertures 84 is 400 microns. The twenty-five micron support wires 80 are coated with lithium-6 to an outer diameter of, preferably, 125 microns. Such a mesh has a 47% open area and contains as much lithium-6 as a 50 micron foil and allows a charged particle to escape the wire for 85% of the neutron captures. It is to be understood at this point that although specific dimensions have been described and illustrated for the support core wires 80 and for the lithium-6 coatings 82, and the center-to-center spacing of the apertures in the mesh, other dimensions could be utilized by judicious selection. The thickness of the lithium-6 coatings 82 could be changed with a corresponding change in the fraction of neutron captures which produce ionization in the counting gas 70. Also, the number of layers of lithium-6 coated mesh per layer of counting wires 44 could be altered. Additionally, although only one layer of counting wires has been described and illustrated, additional layers of counting wires could be utilized if desired, especially in the case where more than three layers of lithium-6 coated mesh are utilized. The present invention may be used, however, with only one layer of count wires for as many as six or more layers of lithium-6 wire mesh. Layers of coated meshes could be placed on both sides of the high voltage counting wires for increased sensitivity.

In order to assemble the respective components of detector 10, all the components may carefully be cleaned and then placed into a glove box without being exposed to the atmosphere. As is well known, a glove box is a device which enables mechanical operations to be manually performed upon various work pieces or components while the components are isolated from both atmospheric gases and from water vapor. It is essential that the layers of lithium-6 coated wire mesh of the present invention be kept isolated from atmospheric gases because of the extreme reactive nature of the lithium-6. The glove box may be filled with pure argon, an inert gas, to prevent any contact between the lithium and the elements or substances with which the lithium would react.

It is preferable that solder be employed to bond the parts of the container 12 together, e.g. to bond front plate **12*c* to the rest of the container 12. Once the internal components are positioned within the container 12 and the front plate 12*c* has been sealed into place, the container 12 may be filled with the counting gas 70 via pinch tube 66. Although tubes 66 and 68** have been described and illustrated as pinch tubes, it is to be understood that shut-off valves may be used instead.

Figure 5:
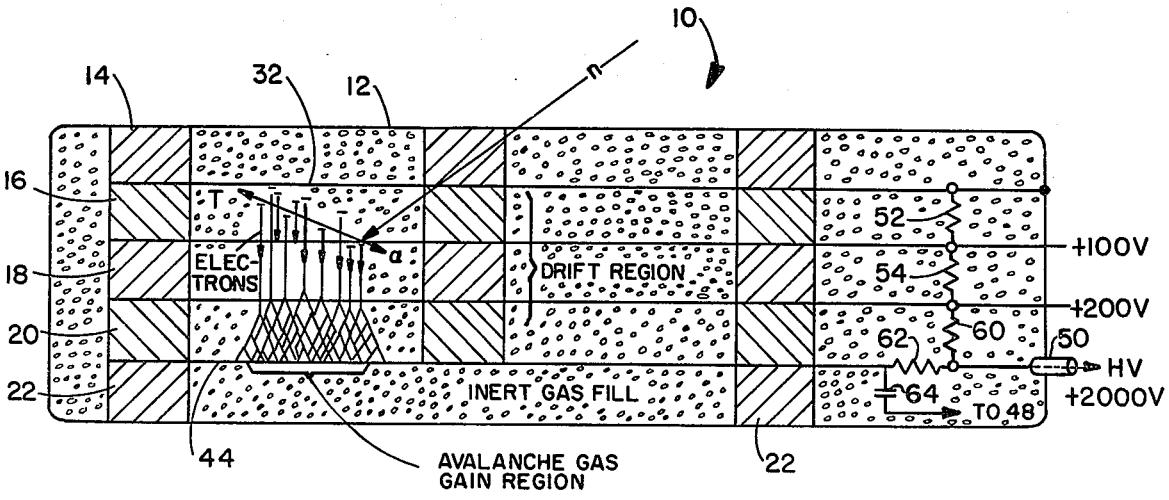
FIG. 5 is a schematic side view of a portion of the present invention illustrating its operation.

The operation of the present invention will now be described. Referring to FIG. 5 there is illustrated a schematic side view of the neutron detector 10 of the present invention with some of the components removed for clarity of illustration. As is shown in FIG. 5, a thermal neutron n is seen entering through neutron transmissive case 12 within the detector 10 and impacting the lithium coating 82 on one of the layers of lithium-6 coated wire mesh. In the example illustrated, the thermal neutron n is shown to be impacting on the lithium-6 wire mesh layer 34. Because the lithium-6 coating 82 is a solid rather than a gas, the density of the lithium nuclei therein is very high and there is a very high probability that the thermal neutron n will react with or be absorbed by a lithium-6 nucleus N. When a neutron reacts with a lithium-6 nucleus, the following reaction occurs: $^{6}Li+n \rightarrow {}^{3}H+{}^{4}He+4.78$ Mev. As is well known, $^{3}H$ is a triton particle. As is also well known, the range of a triton particle traveling through lithium-6 is comparatively long (e.g. 0.135 millimeters). Consequently, in excess of 80% of the triton particles resulting from the reaction between a neutron and a lithium-6 nucleus are able to escape from the layer of lithium 82 deposited over the wire core 80.

Emitted tritons (or alpha particles which are also able to escape the lithium but from a shallower depth) cause counting gas 70 which they encounter to become ionized, generating electrons e. The electrons which are produced by the passage of the charge particles through the counting gas are drifted between the apertures 84 in the mesh layers 32, 34 and 36 down towards the count wires 44 due to the difference in potentials applied to the layers 32, 34 and 36 via the high voltage supply (not shown) and the voltage divider string comprised of the resistors 52, 54 and 60. Also, since the count wires 44 are maintained at a high voltage, the electrons are attracted thereto. When attracted, the electrons come within a range of R of the count wires 44 and enter a region of avalanche multiplication also known as the gas gain region wherein the electrons interact with the counting gas to substantially increase the level of counting gas ionization. Sufficient electrons are released by the counting gas 70 in the avalanche multiplication region of the count wires 44 to generate millivolt size pulses on the count wires 44. Such pulses may be readily detected and measured by the electronic pulse detector 72 to provide a quantitative indication of neutron activity.

Figure 4:
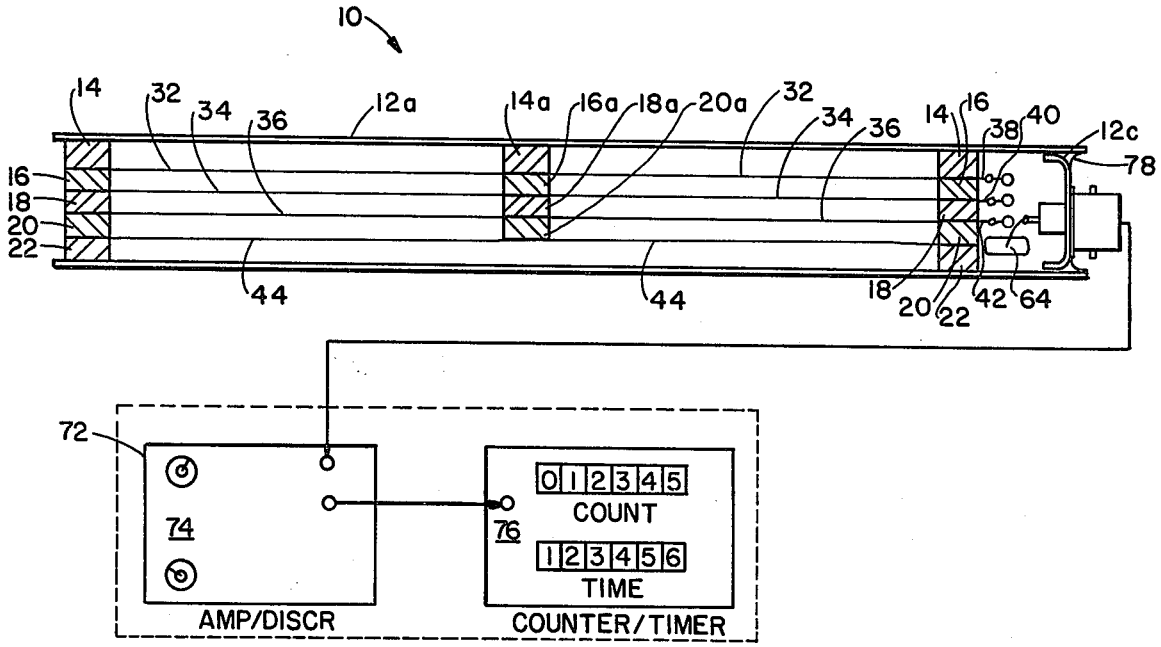
FIG. 4 is a cross-section of the present invention taken through plane IV—IV indicated in FIG. 1.

While using detector 10 to monitor thermal neutrons, it may be very important to prevent gamma rays occurring in the detector from being registered as neutron counts. By making the cross-sectional dimension of the insulating spacers 14, 16, 18, 20 and 22 to be one-eigth inch as is indicated in FIG. 4, the layer of counting gas 70 between adjacent layers of lithium-6 coated wire mesh is too thin to enable sufficient ionization of a gas by a gamma ray. The pulse generated by a gamma ray is therefore detectably less than the pulse generated by a neutron induced triton or alpha particle in detector 10 and may therefore be readily distinguished from a neutron pulse. These gamma ray signals can also be held to a small amplitude pulse by minimizing the gas volume and limiting the amount of high-Z material used in the detector and case 12. Further, the smaller amplitude gamma ray pulses can be discriminated against by judiciously setting the discriminator 74 threshold level.

Obviously, many other modifications and variations of the present invention are possible in the light of the above teachings. It is therefore to be understood that within the scope of the appended claims the invention may be practiced otherwise than as specifically described.

What is claimed is:

1. An apparatus for radiating charged particles in response to impinging neutrons comprising:

means for reacting with or absorbing said neutrons so as to cause the radiation of triton particles comprising a sheet of wire mesh, said wire mesh being coated with a thin layer of lithium-6.

2. The apparatus of claim 1 wherein:

said sheet of wire mesh comprises stainless steel wire.

3. The apparatus of claim 2 wherein:

the diameter of said stainless steel wire is approximately 25 microns.

4. The apparatus of claim 3 wherein:

said wire mesh forms a grid having a plurality of apertures therein, the center-to-center spacing of adjacent ones of said apertures being approximately 400 microns.

5. The apparatus of claim 1 wherein the outside diameter of said lithium-6 layer is approximately 125 microns.

6. A neutron detection apparatus comprising:

at least one sheet of meshed material, said meshed material being coated with a layer of lithium-6;

means comprising a gas, in contact with each of said sheets of lithium-6 coated mesh material, for generating electrons in response to charged particles radiated from said lithium-6 coated mesh material;

means for containing said gas means and each said sheet of meshed material in a closed volume; and monitoring means in contact with said gas means for detecting the generation of electrons by said gas means.

7. The apparatus of claim 6 further comprising:

a voltage divider chain operably coupled to each said sheet of meshed material; and a voltage supply operably coupled to said voltage divider chain.

8. The apparatus of claim 6 wherein:

said gas comprises an inert gas mixture of 90% argon and 10% methane.

9. The apparatus of claim 6 wherein:

said monitoring means is further for providing an output which is related to the number of neutrons impinging upon said apparatus.

10. The apparatus of claim 9 wherein said monitoring means comprises:

a plurality of counting wires enclosed within said containing means.

11. The apparatus of claim 10 wherein said plurality of counting wires are supported on a single insulated frame enclosed within said containing means.

12. The apparatus of claim 11 wherein:

said plurality of counting wires are arranged in parallel relationship to each other.

13. The apparatus of claim 10 wherein said monitoring means further comprises:

electronic processing means operably coupled to said plurality of counting wires and being external to said containing means.

14. The apparatus of claim 13 wherein:

said electronic processing means comprises a pulse detector.

15. The apparatus of claim 13 wherein said electronic processing means comprises:

an amplifier operably coupled to said plurality of counting wires; and a pulse counter operably coupled to said amplifier.

16. The apparatus of claims 6, 10, 14 or 15 wherein said containing means comprises a neutron transmissive, hermetically sealed container.

17. The apparatus of claim 16 wherein said containing means comprises brass.

18. The apparatus of claim 16 wherein:

there are three said sheets of lithium-6 coated meshed material, each said sheet being supported on an insulating frame.

19. The apparatus of claim 18 wherein:

each of said insulating frames are positioned within said containing means in substantially parallel relationship to each other.

20. The apparatus of claim 18 further comprising:

a voltage divider chain operably coupled to each said sheet of meshed material; and a voltage supply operably coupled to said voltage divider.

21. The apparatus of claim 18 wherein each said sheet of meshed material comprises stainless steel wire.

22. The apparatus of claim 21 wherein the diameter of said stainless steel wire is approximately 25 microns.

23. The apparatus of claim 22 wherein:

said wire mesh forms a grid having a plurality of apertures therein, the center-to-center spacing of adjacent ones of said apertures being approximately 400 microns.

24. The apparatus of claim 23 wherein:

the outside diameter of said lithium-6 layer is approximately 125 microns.

* * * * *